US006631614B2

(12) United States Patent
Mandai et al.

(10) Patent No.: US 6,631,614 B2
(45) Date of Patent: Oct. 14, 2003

(54) GAS TURBINE COMBUSTOR

(75) Inventors: Shigemi Mandai, Hyogo-ken (JP); Tetsuo Gora, Hyogo-ken (JP); Katsunori Tanaka, Hyogo-ken (JP); Kouichi Nishida, Hyogo-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 10 days.

(21) Appl. No.: 09/756,188

(22) Filed: Jan. 9, 2001

(65) Prior Publication Data

US 2001/0022088 A1 Sep. 20, 2001

(30) Foreign Application Priority Data

Mar. 14, 2000 (JP) ..... 2000-070893

(51) Int. Cl.[7] ..... F23R 3/30
(52) U.S. Cl. ..... 60/737; 60/746
(58) Field of Search ..... 60/737, 746, 747

(56) References Cited

U.S. PATENT DOCUMENTS 5,062,792 A * 11/1991 Maghon ..... 60/747
5,359,847 A 11/1994 Pillsbury et al.
5,528,896 A 6/1996 Alary et al.
5,558,515 A 9/1996 Althaus et al.
5,927,076 A 7/1999 Pillsbury
6,122,916 A * 9/2000 Amos et al. ..... 60/747

FOREIGN PATENT DOCUMENTS

| | | |
|---|---|---|
| EP | 0 643 267 | 3/1995 |
| EP | 0 935 097 | 8/1999 |
| JP | 6-129640 | 5/1994 |
| JP | 9-21531 | 1/1997 |
| WO | WO 99/35441 | 7/1999 |

* cited by examiner

*Primary Examiner*—Michael Koczo
(74) *Attorney, Agent, or Firm*—Oblon, Spivak, McClelland, Maier & Neustadt, P.C.

(57) ABSTRACT

A gas turbine combustor, in which plural pre-mixers that inject fuel into swirling air passages are arranged to surround a pilot burner, and a pilot flame, guided by a pilot cone in the shape of a flaring pipe and provided at the rear end of the pilot burner, is mixed with a pre-mixture blown out from the pre-mixers to obtain a combustion gas, comprising flame-stabilizing means. The flame-stabilizing means lower the disturbance in a region where the pre-mixture and the pilot flame are mixed or stabilize the pilot flame, so that the flame generated by igniting the pre-mixture with the pilot flame is stabilized. By stabilizing the flame, combustion with a leaner air-fuel ratio is possible, and thereby the amount of NOx can be decreased.

8 Claims, 8 Drawing Sheets

GAS TURBINE COMBUSTOR

BACKGROUND OF THE INVENTION

1. Field of the Invention

The present invention relates to a gas turbine combustor and, particularly, to a gas turbine combustor of the pre-mixing type.

2. Description of the Related Art

Gas turbines have been extensively used in a variety of fields such as electricity generating plants, etc. Gas turbines produce power by rotating turbine blades using the combustion gas which is generated in a combustion chamber, by injecting fuel into air that has reached a high temperature after being compressed by a compressor, or by injecting the fuel into a premixture of air and fuel. In order to improve the efficiency of the gas turbine, it is desired that the temperature of the combustion gas at the inlet of the turbine blades is as high as possible, and efforts have been made to increase the temperature of the combustion gas.

In recent years, however, it has been urged to decrease nitrogen oxides (NOx) to meet exhaust gas regulations. NOx increases rapidly when the combustion gas is heated to a certain temperature. To decrease NOx, a maximum temperature of the combustion gas must be suppressed to not exceed the temperature at which NOx starts to increase rapidly.

The temperature of the combustion gas depends on the amount of air for combustion relative to the amount of fuel at the time of combustion; i.e., the temperature of the combustion gas decreases with an increase of the amount of the air for combustion and increases with a decrease of the amount of the air for combustion. To decrease NOx, therefore, it is necessary to accomplish combustion with a lean air-fuel ratio by increasing the amount of the air for combustion.

It has therefore been attempted to stabilize the flame to obtain combustion with a lean air-fuel ratio. For example, Japanese Unexamined Patent Publication (Kokai) No. 6-129640 discloses a cone that expands like a megaphone near the outlet of a pilot nozzle (see FIGS. 7A and 7B). In the combustor of this structure, however, a pre-mixture blown out from the swirling passages flows nearly parallel to the center axis of the turbine whereas the pilot flame flows along the inner surface of the pilot cone, so that the two meet at some angle. Besides, since the flow velocities are different between them, a great disturbance occurs in this region, and the flame loses stability making it difficult to make the fuel density lean to a sufficient degree to decrease NOx.

SUMMARY OF THE INVENTION

In view of the above-mentioned problem, it is an object of the present invention to provide a gas turbine combustor capable of accomplishing combustion even at a lean fuel density, while maintaining good combustion stability to decrease NOx.

According to the present invention, there is provided a gas turbine combustor in which plural pre-mixers that inject fuel into swirling air passages are arranged to surround a pilot burner, and a pilot flame, guided by a pilot cone in the shape of a flaring pipe and provided at the rear end of the pilot burner, is mixed with a pre-mixture blown out from the pre-mixers to obtain a combustion gas, wherein the gas turbine combustor comprises flame-stabilizing means which lower the disturbance in a region where the pre-mixture and the pilot flame are mixed to stabilize the pilot flame, so that the flame generated by igniting the pre-mixture with the pilot flame is stabilized.

The present invention may be more fully understood from the description of the preferred embodiments of the invention set forth below, together with the accompanying drawings.

DESCRIPTION OF THE PREFERRED EMBODIMENTS

Figure 8:
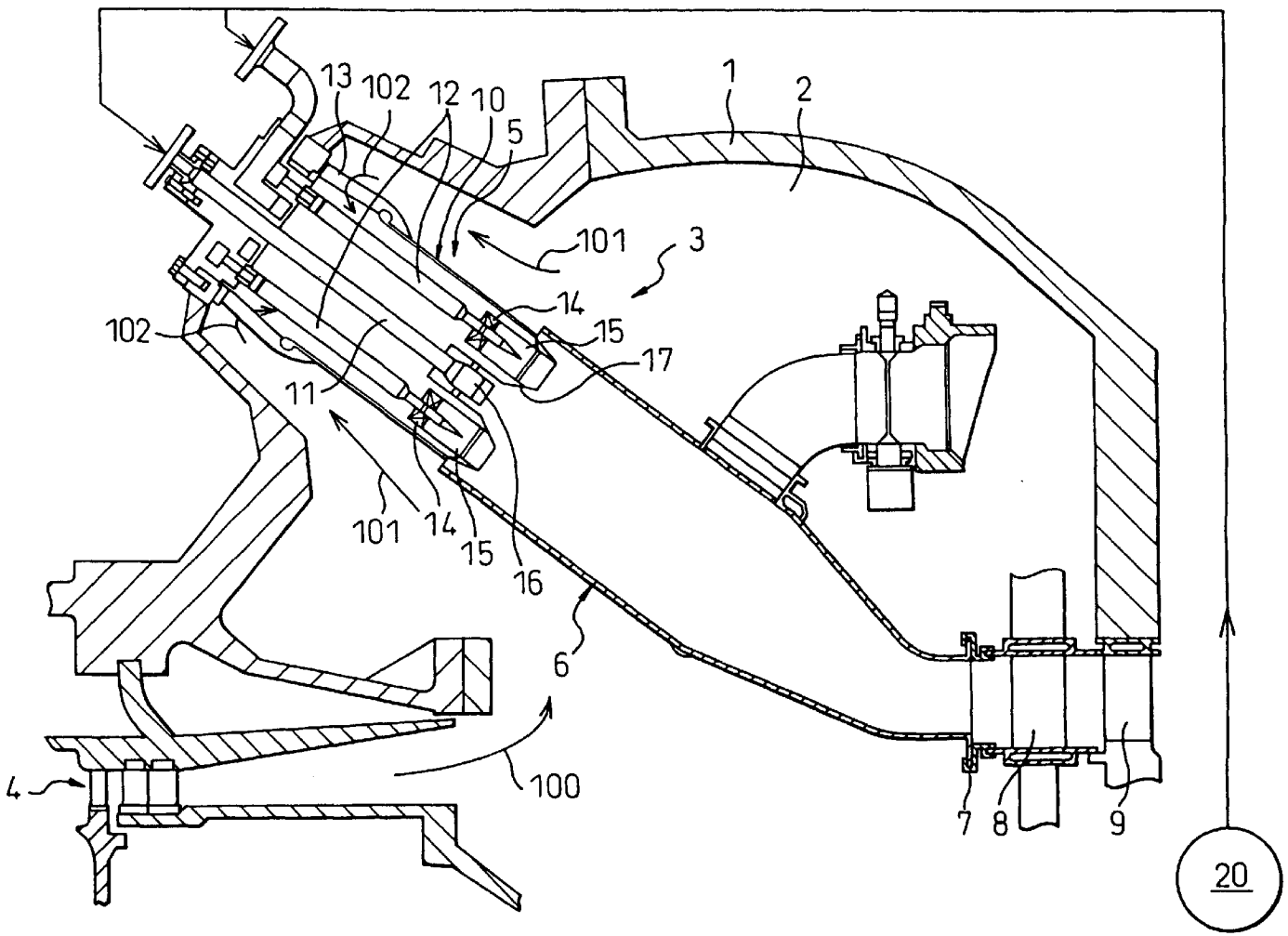
Fig.8 (PRIOR ART)
FIG. 8 is a view illustrating a fundamental structure of the periphery of a gas turbine, according to the prior art, to which the present invention is applied.

Described below with reference to FIG. 8 is a basic structure of the periphery of a combustor, in a conventional gas turbine, to which the present invention can be applied.

A combustor 3 is arranged in an inner space 2 formed by an outer casing 1, and air at a high temperature and compressed by a compressor 4 (partly shown) is introduced into the inner space 2 as indicated by an arrow 100. The combustor 3 includes a combustion chamber 6 for generating a combustion gas by burning the fuel in air, and a front chamber 5 for introducing the fuel and air into the combustion chamber 6. The rear end of the combustion chamber 6 is coupled to stationary blades 8 via a seal 7, and turbine blades 9 are disposed downstream of the stationary blades 8.

The front chamber 5 is constituted by a pilot nozzle 11 and plural main nozzles 12 arranged in the inner casing 10. The compressed air at a high temperature introduced into the inner space 2 from the compressor 4 as indicated by an arrow 101 flows toward the upstream side passing around the inner casing 10, and is introduced into the inside of the inner casing 10 as indicated by an arrow 102 through a combustion air inlet 13 formed at an upstream end of the inner casing 10. The air introduced into the inside of the inner casing 10 swirls as it flows through plural swirling passages 15 having swirlers 14, and into which the fuel is injected from main nozzles 12 to form a pre-mixture which is sent into the combustion chamber 6.

Further, the air introduced into the inside of the inner casing 10 passes through air passages 11*a* (see FIG. 7A) surrounding the pilot nozzle 11 and the fuel injected from the pilot nozzle 11 diffusively combust downstream of the pilot nozzle 11 to form a pilot flame. The pilot flame ignites the pre-mixture blown out from a swirling passage 16, thereby to produce a combustion gas.

An end 16 of the pilot nozzle 11 is disposed in a pilot cone 17 that expands like a megaphone.

Figure 7B:
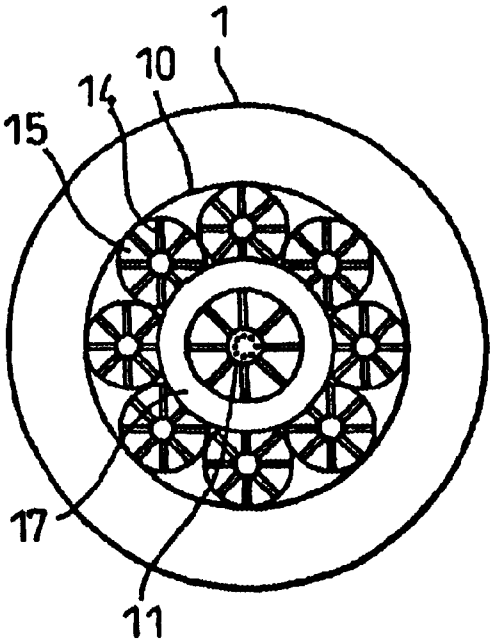
Fig.7B (PRIOR ART)
FIG. 7B is a view of the combustor according to the prior art as viewed in the axial direction.
Figure 7A:
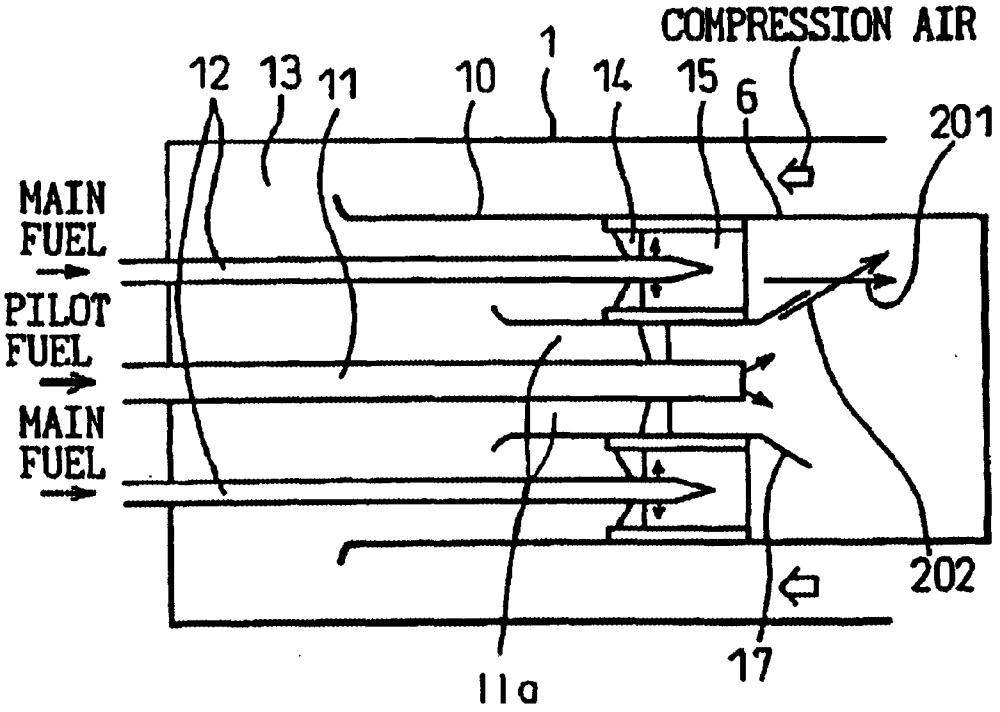
Fig.7A (PRIOR ART)
FIG. 7A is a sectional view of a combustor according to a prior art cut along a plane through the center axis of the turbine.

FIG. 7A is a sectional view of a combustor 3 of a gas turbine according to the above prior art cut along a plane through the center axis of the turbine, and FIG. 7B is a view thereof as viewed in the axial direction.

The pre-mixture from the swirling passages 15 flows nearly parallel along the axis as indicated by an arrow 201 whereas the pilot flame flows along the inner surface of the pilot cone 17 as indicated by an arrow 202, and the two streams meet at some angle. Since the two streams flow at different velocities, there is considerable turbulence in the region where they meet, and the flame loses stability.

Described below are embodiments of the gas turbine combustor of the present invention that can be applied to the above-mentioned gas turbine of the prior art.

As in FIGS. 7A and 7B, FIGS. 1A and 1B illustrate the combustor 3 of the gas turbine of FIG. 8 but they incorporate the features of a first embodiment. According to the first embodiment, the pilot cone 17 has a rear end edge 19 which is formed to be nearly parallel with the axis such that the pilot flame can be slightly mixed with the pre-mixture.

Therefore, while the pre-mixture from the swirling passages 15 flows along the outer surface of the pilot cone 17 as indicated by an arrow 201, the pilot flame flows along the surface of the pilot cone 17 as indicated by an arrow 202. Therefore, the two streams meet together in a nearly parallel state producing little disturbance, and the flame is stabilized. With the stability of the frame being improved, the combustion is accomplished at a leaner air-fuel ratio, and the Nox amount can be decreased.

Figure 1B:
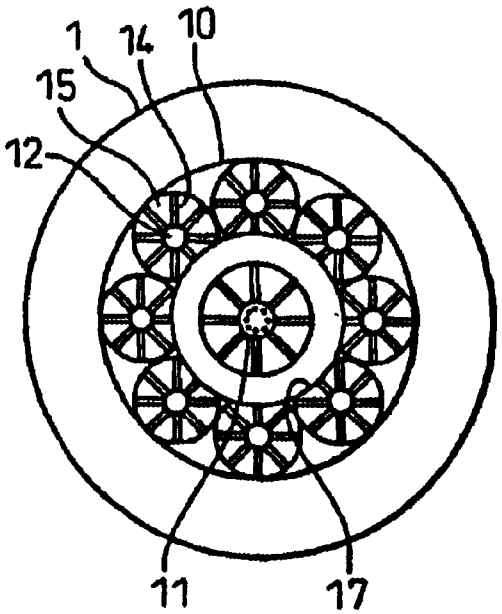
FIG. 1B is a view of the combustor according to the first embodiment as viewed in the axial direction.
Figure 1A:
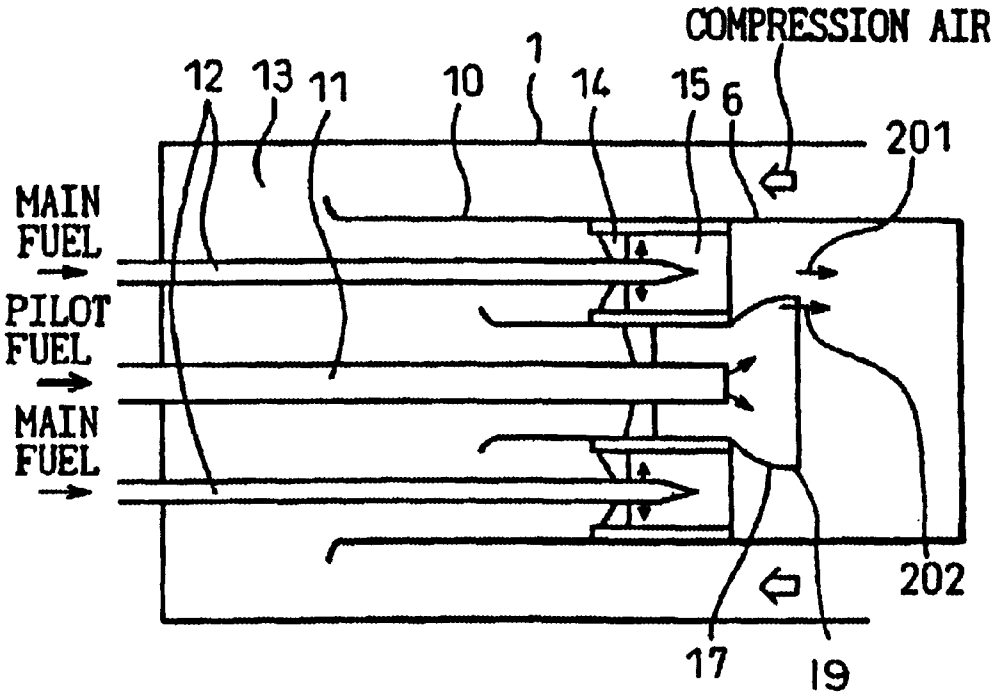
FIG. 1A is a sectional view of a combustor according to a first embodiment cut along a plane through the center axis of the turbine.
Figure 2B:
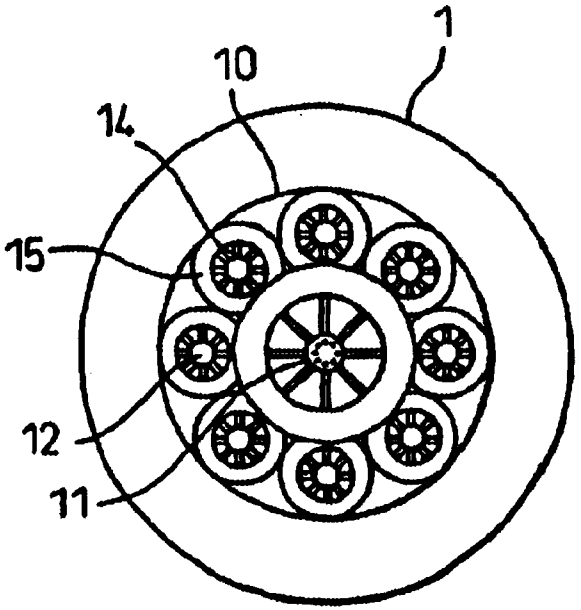
FIG. 2B is a view of the combustor according to the second embodiment as viewed in the axial direction.
Figure 2A:
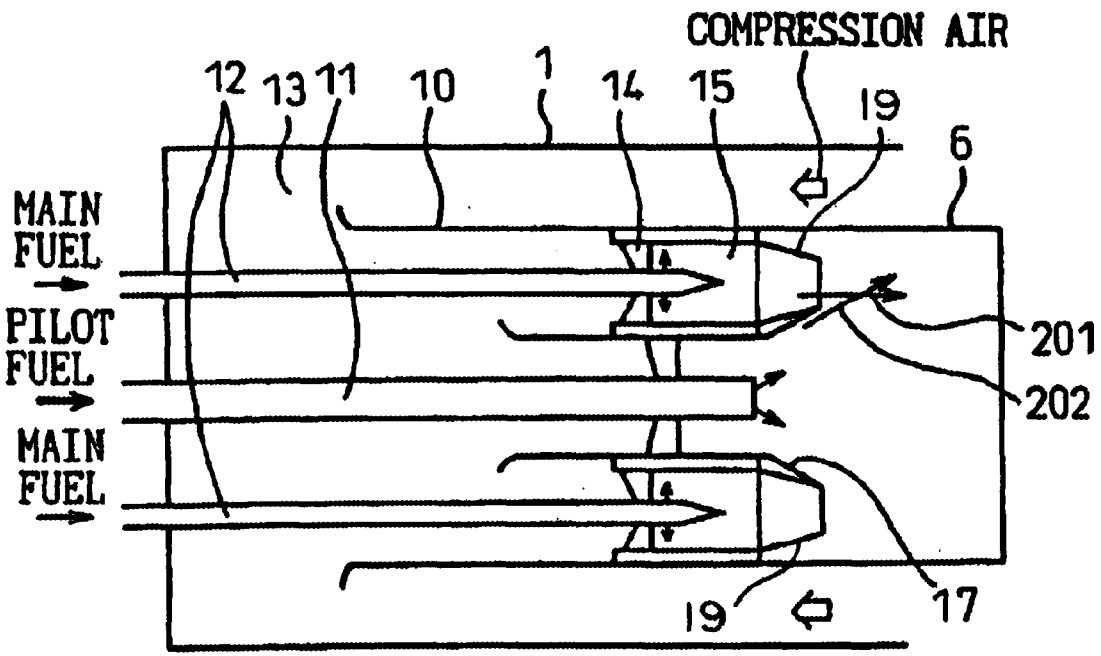
FIG. 2A is a sectional view of the combustor according to a second embodiment cut along a plane through the center axis of the turbine.

FIGS. 2A and 2B illustrate the combustor 3 of a second embodiment similar to FIGS. 1A and 1B. According to the second embodiment as shown, the rear end edges 19 of the swirling passages 15 are contracted. The pre-mixture blown out from the contracted rear end edges has a flowing velocity faster than when the rear end edges are not contracted, and the disturbance is weakened correspondingly.

The pilot flame meets the pre-mixture blown out from the swirling passages 15 at an angle the same as that of the prior art. However, since the pre-mixture is only weakly disturbed as described above, the flame is stabilized to obtain the same effect as that of the first embodiment.

Figure 3B:
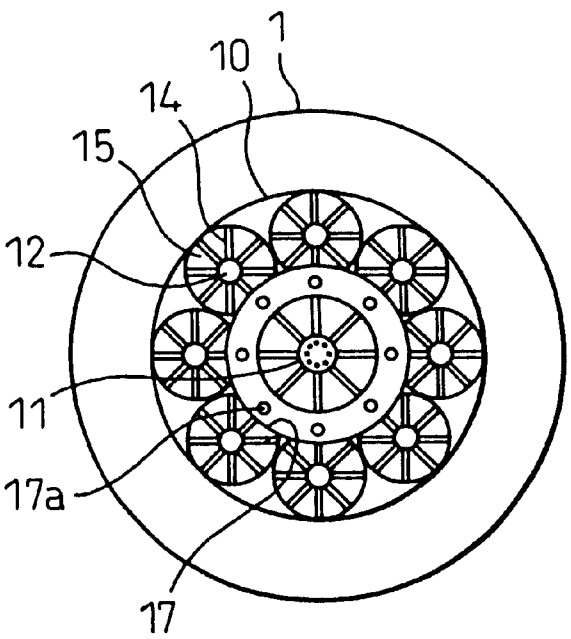
FIG. 3B is a view of the combustor according to the third embodiment as viewed in the axial direction.
Figure 3A:
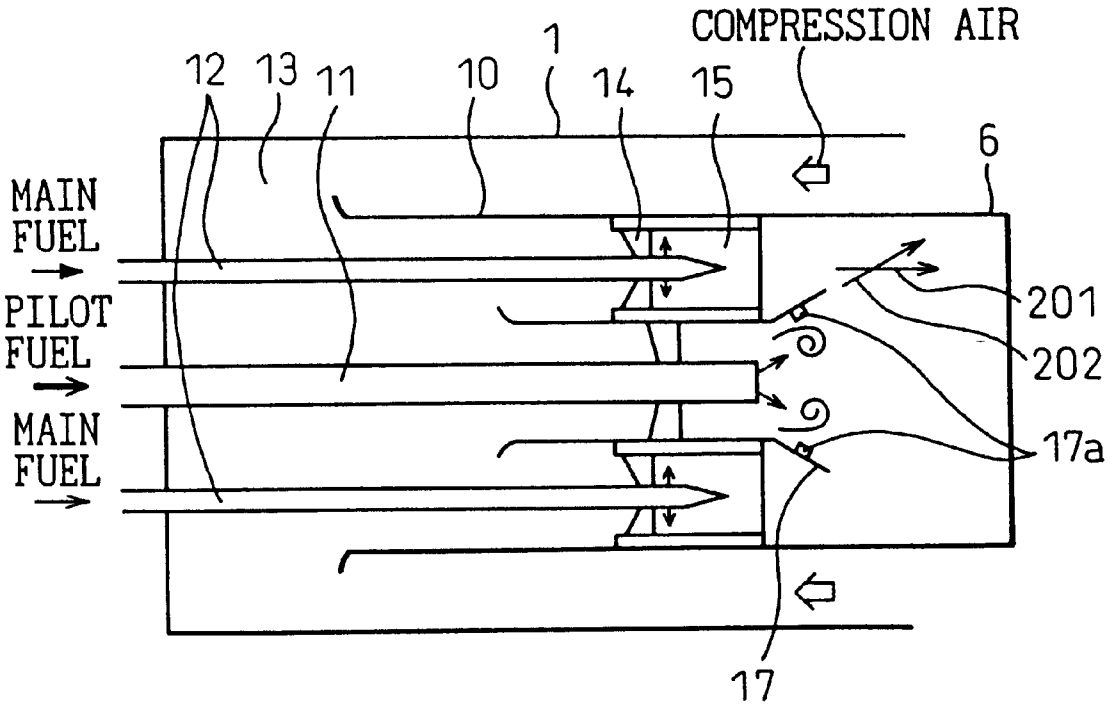
FIG. 3A is a sectional view of the combustor according to a third embodiment cut along a plane through the center axis of the turbine.

A third embodiment will be described next. The third embodiment is aiming at stabilizing the pilot flame. FIGS. 3A and 3B illustrate the combustor 3 of the third embodiment wherein protuberances 17*a* are attached to the inner surface of the pilot cone 17. The protuberances 17*a* help form a circulating stream of air that has passed by flowing around the pilot nozzle 11 and, hence, a strong and stable pilot flame is formed. This strong pilot flame contacts and mixes with the pre-mixture from the swirling passages 15. Here, the pilot flame is so strong that a stable flame can be formed even when the pre-mixture is greatly disturbed as it is blown from the swirling passages 15 as in the prior art. This is also due to the effect of the protuberances 17*a* that work to decrease the angle of the pilot flame.

Though the protuberances 17*a* are shown as being separated away from one another, they may be formed in an annular form and continuous in the circumferential direction.

Figure 4B:
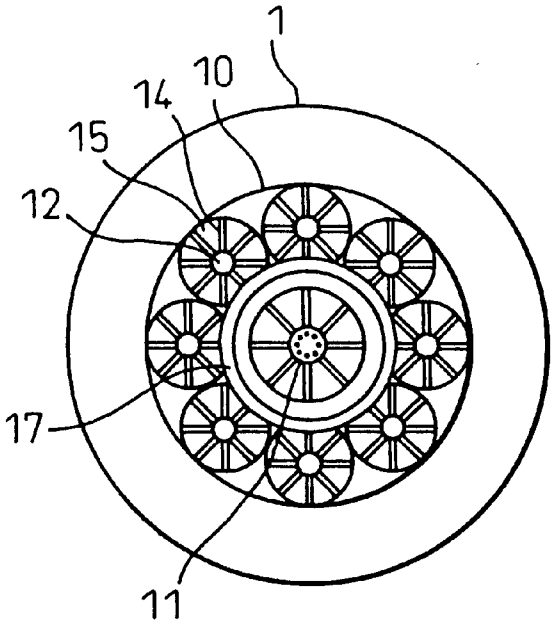
FIG. 4B is a view of the first variation of the combustor according to the third embodiment as viewed in the axial direction.
Figure 4A:
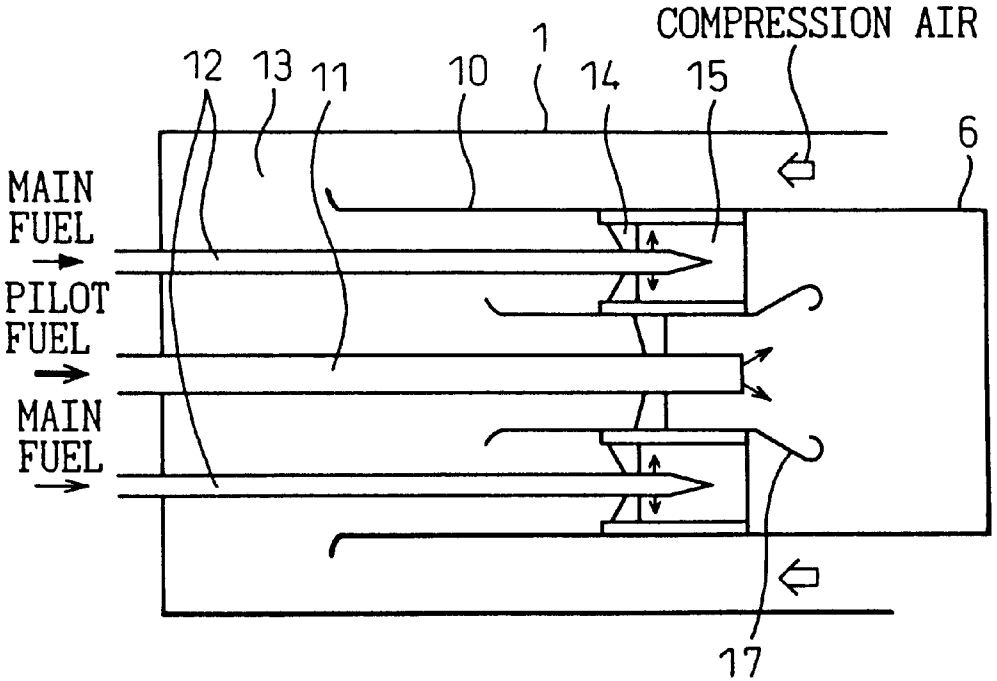
FIG. 4A is a sectional view of a first variation of the combustor according to the third embodiment cut along a plane through the center axis of the turbine.

FIGS. 4A and 4B illustrate a first variation of the third embodiment wherein the rear end edge of the pilot cone 17 is folded inward instead of providing protuberances 17*a* to provide the same action and effect as that of the third embodiment.

Figure 5B:
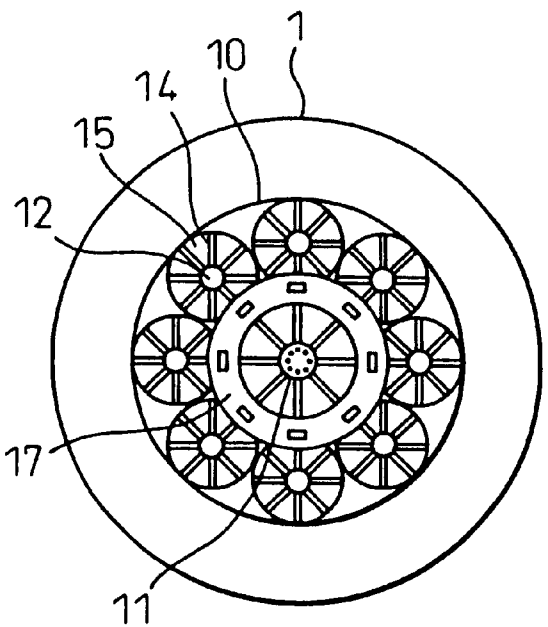
FIG. 5B is a view of the second variation of the combustor according to the third embodiment as viewed in the axial direction.
Figure 5A:
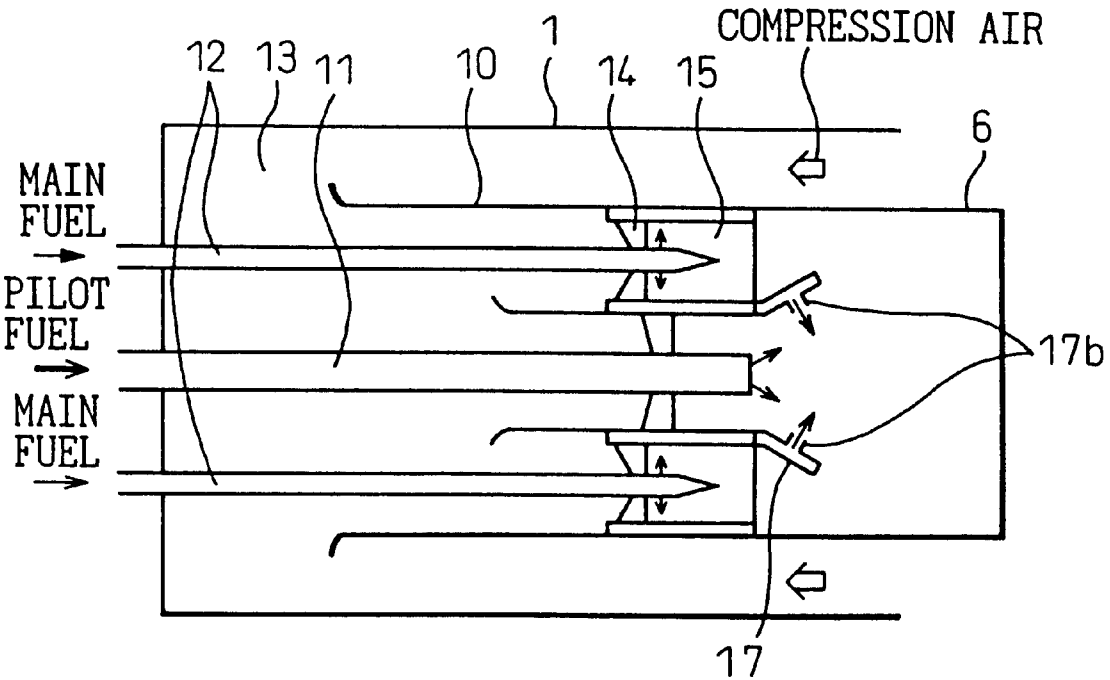
FIG. 5A is a sectional view of a second variation of the combustor according to the third embodiment cut along a plane through the center axis of the turbine.

FIGS. 5A and 5B illustrate a second variation of the third embodiment wherein air blow ports 17*b* are formed in the inner surface of the pilot cone 17, instead of providing the protrusions 17*a*, to blow the air toward the inside, in order to obtain the same action and effect as that of the third embodiment.

Figure 6B:
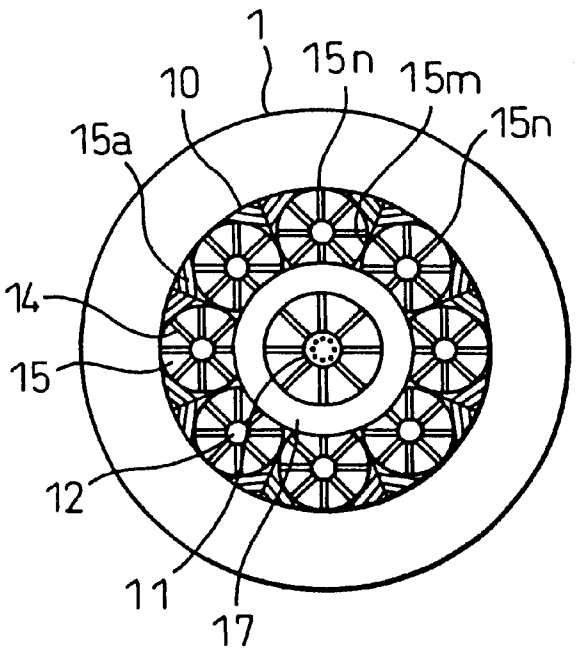
FIG. 6B is a view of the combustor according to the fourth embodiment as viewed in the axial direction.
Figure 6A:
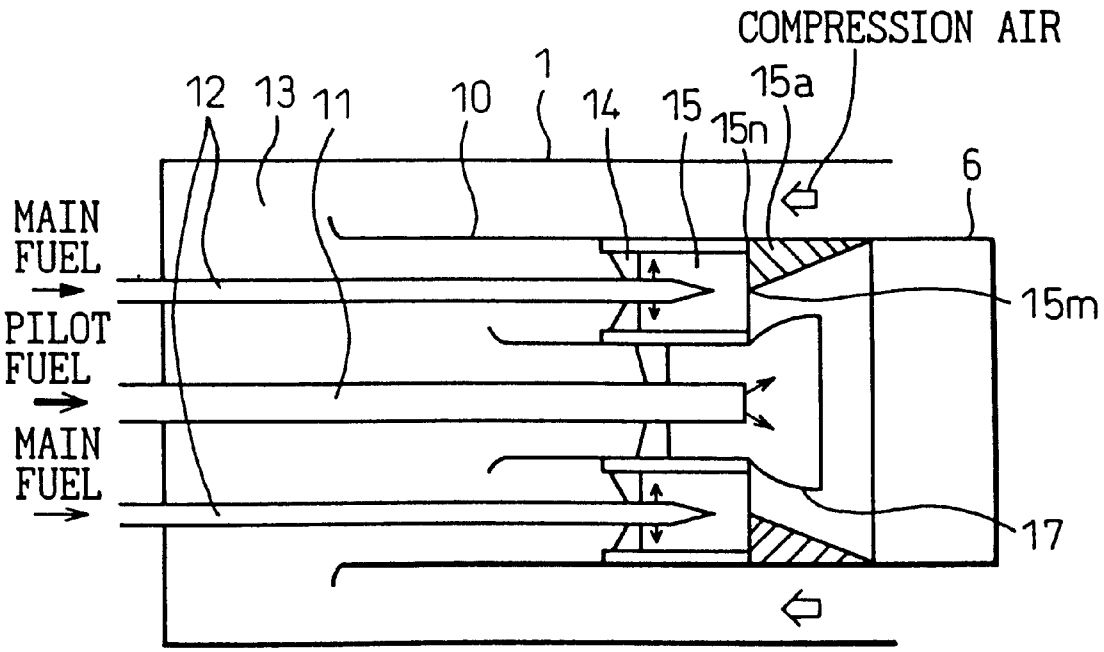
FIG. 6A is a sectional view of the combustor according to a fourth embodiment cut along a plane through the center axis of the turbine.

A fourth embodiment will be described next. FIGS. 6A and 6B illustrate the fourth embodiment. According to the fourth embodiment, stagnation of the pre-mixture is prevented by providing guide members 15*a* that extend toward the downstream side to be smoothly connected to the combustion chamber 6 from an intermediate junction point 15*m* where the outer circumferential rear end edge of the swirling passage 15 is joined to a neighboring swirling passage 15 to an outer junction point 15*n* at where the outer circumferential rear end edge of the swirling passage 15 is joined to the combustion chamber 6.

Thus, the pre-mixture, blown out from the intermediate junction point 15*m* to the outer junction point 15*n* at the rear end edge of each swirler, flows toward the downstream without stagnating. This prevents a backfire phenomenon in that the flame proceeds toward the upstream side. Therefore, the combustion is stabilized and no combustion takes place near the wall surfaces of the combustion chamber 6, which can be a cause of fluctuating combustion.

The guide members 15*a* may be combined with other embodiments or may be used by themselves.

According to the gas turbine combustor of the present invention, plural pre-mixers that inject fuel into swirling air passages are arranged to surround a pilot burner, and a pilot flame, guided by a pilot cone of the shape of a flaring pipe provided at the rear end of the pilot burner, is mixed with a pre-mixture blown out from the pre-mixers to obtain a combustion gas, wherein provision is made of flame-stabilizing means for stabilizing the flame that is produced as a result of igniting the pre-mixture gas while lowering the disturbance in a region where the pre-mixture and the pilot frame are mixed together to stabilize the pilot flame. Since the flame is stabilized, the combustion with more leaner air-fuel ratio is possible so as to decrease the amount of NOx.

What is claimed is:

1. A gas turbine combustor for generating combustion gas by igniting a pre-mixture with a pilot flame, comprising:

a pilot nozzle for producing the pilot flame at a rear end of the pilot nozzle;

plural pre-mixers for producing pre-mixture and arranged to surround the pilot nozzle, said plural pre-mixers including swirl air passages and main nozzles for injecting fuel into swirling air generated by said swirl air passages;

a pilot cone arranged at a rear end of the pilot nozzle to guide the pilot flame into the pre-mixture blown out from the pre-mixers so as to mix the pilot flame with the pre-mixture to ignite the pre-mixture and thereby generate combustion gas; and a flame-stabilizing means for stabilizing a flame produced by igniting pre-mixture with the pilot flame for generating combustion gas.

2. A gas turbine combustor for generating combustion gas by igniting a pre-mixture with a pilot flame, comprising:

a pilot nozzle for producing the pilot flame at a rear end of the pilot nozzle;

plural pre-mixers for producing pre-mixture and arranged to surround the pilot nozzle, said plural pre-mixers including swirl air passages and main nozzles for injecting fuel into swirling air generated by said swirl air passages;

a pilot cone arranged at a rear end of the pilot nozzle to guide the pilot flame into the pre-mixture blown out from the pre-mixers so as to mix the pilot flame with the pre-mixture to ignite the pre-mixture and thereby generate combustion gas; and a flame-stabilizing means for stabilizing a flame produced by igniting pre-mixture with the pilot flame for generating combustion gas, wherein the flame-stabilizing means is made by forming the rear end of the pilot cone to be nearly parallel with longitudinal axes of the plural main nozzles so that the pilot flame mixes slightly with the pre-mixture.

3. A gas turbine combustor according to claim 1, wherein the flame-stabilizing means comprises contracting the areas at the outlets of the pre-mixers to be smaller than the areas of the swirling air passage portions at the swirler, so that the velocity of the pre-mixture blown out from the pre-mixers are increased in the axial direction to weaken the disturbance of the pre-mixture that is mixed with the pilot flame.

4. A gas turbine combustor according to claim 1, wherein the flame-stabilizing means is a circulating stream generator means provided on the inner surface of the pilot cone to stabilize the pilot flame.

5. A gas turbine combustor according to claim 4, wherein the circulating stream generator means consists of protuberances formed on the inner surface of the pilot cone.

6. A gas turbine combustor according to claim 5, wherein a protuberance is formed by folding the rear end edge of the pilot cone.

7. A gas turbine combustor according to claim 4, wherein the protuberance is an air injection means for injecting the air into the inside from the inner surface of the pilot cone.

8. A gas turbine combustor according to claim 1, comprising a stagnation preventing means which is formed by extending portions of the circumferential rear ends of the pre-mixers, between intermediate connection points where neighboring pre-mixers are connected to each other and outer connection points where each pre-mixers are connected to a inner casing forming a combustion chamber, toward the downstream end connected smoothly to the inner casing, so that generation of a stagnation region is prevented.

* * * * *